US010049795B2

(12) United States Patent
Hirschmann et al.

(10) Patent No.: US 10,049,795 B2
(45) Date of Patent: Aug. 14, 2018

(54) SURGE PROTECTION DEVICE, COMPRISING AT LEAST ONE SURGE ARRESTER AND ONE THERMALLY TRIPPABLE SWITCHING DEVICE CONNECTED IN SERIES WITH THE SURGE ARRESTER

(71) Applicant: DEHN + SÖHNE GMBH + CO. KG, Neumarkt (DE)

(72) Inventors: Helmut Hirschmann, Berg (DE); Georg Wittmann, Lauterhofen (DE); Edmund Zäuner, Berching/Pollanten (DE)

(73) Assignee: DEHN + SÖHNE GMBH + CO. KG, Neumarkt (DE)

( * ) Notice: Subject to any disclaimer, the term of this patent is extended or adjusted under 35 U.S.C. 154(b) by 215 days.

(21) Appl. No.: 15/031,043

(22) PCT Filed: Oct. 13, 2014

(86) PCT No.: PCT/EP2014/071834
§ 371 (c)(1),
(2) Date: Apr. 21, 2016

(87) PCT Pub. No.: WO2015/058985
PCT Pub. Date: Apr. 30, 2015

(65) Prior Publication Data

US 2016/0240290 A1 Aug. 18, 2016

(30) Foreign Application Priority Data

Oct. 22, 2013 (DE) ..... 10 2013 017 597
Nov. 18, 2013 (DE) ..... 10 2013 019 390

(51) Int. Cl.
*H01C 7/12* (2006.01)
*H01T 1/14* (2006.01)
(Continued)

(52) U.S. Cl.
CPC ..... *H01C 7/126* (2013.01); *H01H 37/76* (2013.01); *H01H 37/761* (2013.01);
(Continued)

(58) Field of Classification Search
CPC ..... H01C 7/126; H01H 37/76; H01H 37/761; H01H 71/10; H01H 85/0052; H01T 1/14
See application file for complete search history.

(56) References Cited

U.S. PATENT DOCUMENTS 7,684,166 B2 * 3/2010 Donati ..... H01C 7/126 361/103
8,031,456 B2 * 10/2011 Wang ..... H01T 1/14 361/117
(Continued)

FOREIGN PATENT DOCUMENTS

DE 295 19 313 1/1996 ..... H01C 7/12
DE 10 2011 018 556 8/2012 ..... H01C 7/12
(Continued)

OTHER PUBLICATIONS

The Notification Concerning Transmittal of the International Preliminary Report on Patentability (Chapter I of the Patent Cooperation Treaty), in English, dated May 6, 2016, the English translation of the International Preliminary Report on Patentability (Chapter I of the Patent Cooperation Treaty), dated Apr. 26, 2016, the Written Opinion of the International Searching Authority, in English (Apr. 26, 2016—mailed with the English translation of the International Preliminary Report on Patentability), and the International Search Report, in English, dated Dec. 22, 2014, which were issued by the International Bureau of WIPO in Applicant's corresponding international PCT application having Serial No. PCT/EP2014/071834, filed on Oct. 13, 2014.

*Primary Examiner* — Scott Bauer
(74) *Attorney, Agent, or Firm* — Bodner & O'Rourke, LLP; Gerald T. Bodner; Christian P. Bodner

(57) ABSTRACT

The invention relates to a surge protection device, comprising at least one surge arrester and one thermally trippable switching device connected in series with the surge arrester, wherein the above-mentioned means form a structural unit and the thermal tripping means is arranged in the region in which heating of the surge arrester is to be expected on overloading thereof. The thermal tripping means is in the form of a stop part through which there is no operating or surge current flowing and which effects or enables unlatching of the switching device in the case of thermal overload. Furthermore, the stop part is coupled thermally and mechanically to a surface side of the surge arrester and blocks the movement path of a mechanically prestressed unlatching slide. In accordance with the invention, a contact platelet is inserted in the unlatching slide, said contact platelet producing an electrical connection between elements of the switching device and, with unlatching, the contact platelet is subjected to a shifting movement resulting in an interruption to the series circuit and movement of the unlatching slide into the space previously assumed by the contact platelet, wherein at least the section of that region of the unlatching slide which separates the elements of the switching device is insulating.

10 Claims, 4 Drawing Sheets

Figure 1:
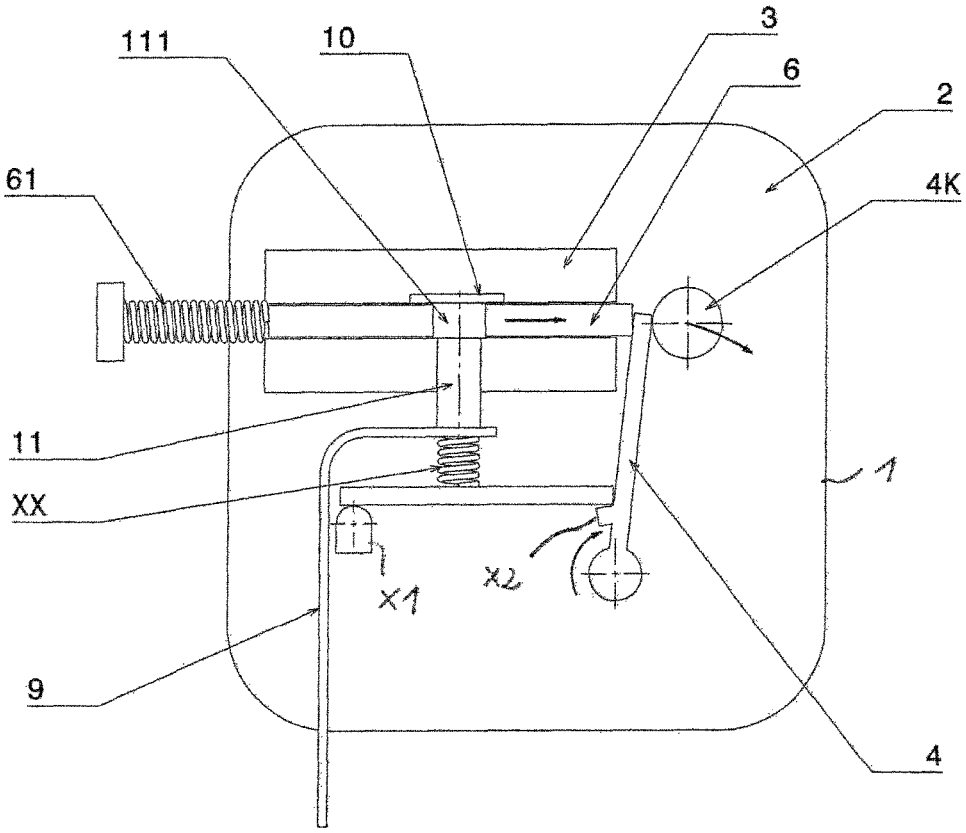

(51) Int. Cl.

| | |
|---|---|
| ***H01H 85/00*** | (2006.01) |
| ***H01H 37/76*** | (2006.01) |
| ***H01H 71/10*** | (2006.01) |
| *H01H 85/048* | (2006.01) |
| *H01H 85/38* | (2006.01) |

(52) U.S. Cl.
CPC ..... *H01H 71/10* (2013.01); *H01H 85/0052* (2013.01); *H01T 1/14* (2013.01); *H01H 2085/0486* (2013.01); *H01H 2085/381* (2013.01)

(56) References Cited

U.S. PATENT DOCUMENTS

| | | | | |
|---|---|---|---|---|
| 9,007,163 | B2 * | 4/2015 | Duval | H01C 7/126 337/1 |
| 9,165,702 | B2 * | 10/2015 | Hagerty | H01C 7/126 |
| 9,172,236 | B2 | 10/2015 | Hirschmann et al. | |
| 2006/0245125 | A1 * | 11/2006 | Aszmus | H01C 7/126 361/56 |
| 2009/0079535 | A1 | 3/2009 | Jeong et al. | 338/21 |
| 2009/0302992 | A1 * | 12/2009 | Cernicka | H01C 7/126 337/412 |
| 2011/0013330 | A1 * | 1/2011 | Crevenat | H01H 83/10 361/115 |
| 2011/0032651 | A1 * | 2/2011 | Depping | H01H 37/761 361/91.1 |
| 2012/0014028 | A1 * | 1/2012 | Daum | H01C 7/12 361/118 |

FOREIGN PATENT DOCUMENTS

| | | | |
|---|---|---|---|
| EP | 1 447 831 | 8/2004 | H01H 83/10 |
| EP | 2 065 914 | 6/2009 | H01H 83/10 |
| EP | 2 553 691 | 2/2013 | H01C 7/12 |
| WO | WO 2012/110135 | 8/2012 | H01C 7/12 |

* cited by examiner

SURGE PROTECTION DEVICE, COMPRISING AT LEAST ONE SURGE ARRESTER AND ONE THERMALLY TRIPPABLE SWITCHING DEVICE CONNECTED IN SERIES WITH THE SURGE ARRESTER

The invention relates to a surge protection device, comprising at least one surge arrester and one thermally trippable switching device connected in series with the surge arrester, wherein the aforementioned means form a structural unit and the thermal tripping means is arranged in the region in which heating of the surge arrester is to be expected on overloading thereof, wherein the thermal tripping means is formed as a stop part through which no operating or surge current flows and which releases unlatching of the switching device in the case of thermal overload, wherein the stop part is further coupled thermally and mechanically to a surface side of the surge arrester and blocks the movement path of a mechanically prestressed unlatching slide, according to the preamble of claim 1.

A surge arrester based on a varistor is known from the prior art from DE 295 19 313 U1, wherein it ensures direct transfer of the impermissible heat produced on the varistor in the case of damage to a thermal tripping device. A support wall is provided for this purpose in the plug-in part, wherein the varistor is attached to a side surface of the support wall, and the thermal tripping device and the associated switching means are attached to the other side surface of the support wall. As a result, the thermal tripping device is situated opposite of the varistor. In one embodiment, one or several terminal lugs of the varistor are introduced through the separating wall into the region in which the thermal tripping device and the respective switching means are situated.

The guidance of the operating current and the occurring overload currents occurs via contact means of a plug-in part, which can be introduced on its part into a base part. The current reaches the varistor via said switching means, such that current flows through the actual thermal tripping means, which is especially formed as a solder.

The entire embodiment according to DE 295 19 313 U1 can only switch very low currents in a secure manner. An additional external switching member in form of a separate switching means or a fuse for example is necessary in the case of the occurrence of short circuit currents or direct current applications.

EP 1 447 831 B or EP 2 065 914 A1 show identical combinations of surge plug-in parts with additional switching devices, which are either introduced into a common base housing or are surrounded by such a housing. These solutions there offer tripping or cut-off behaviour which cannot be adapted to the special properties of the respectively used surge arresters such as varistors.

A surge protection apparatus, comprising at least one surge arrester and a thermally trippable switching device which is connected in series with the surge arrester, is known from the prior art from DE 10 2011 018 556 A1. The tripping means there is formed as a stop part through which no operating or surge current flows and which releases unlatching of the switching device in the case of thermal overload, wherein it has an increased self-quenching capability. Such a solution intends to automatically cut off network-related fault or short-circuit currents by the internal switching device, which currents do not yet lead to the tripping of external fuses, so that a wide-reaching, comprehensive self-protection range is obtained. The stop part known from the prior art according to DE 10 2011 018 556 A1 is coupled thermally and mechanically to the surge arrester and blocks the movement path of an unlatching slide that is also provided.

In the case of opening of the switching device, a separating element enters into the contact elements moving away from each other, which separating element can consist of an insulating material that emits a quenching gas such as POM.

The required constructional and production complexity is disadvantageous in the solution according to DE 10 2011 018 556 A1 however. The contact elements there need to engage into each other, wherein at least one of the contact elements must be formed in a movable manner.

Based on the statements made above, it is therefore the object of the invention to provide a further developed surge protection device, comprising at least one surge arrester and one thermally trippable switching device connected in series with the surge arrester, wherein a solution is used based on a tripping means through which no surge current flows, but which minimises the constructional and production complexity in combination with a simultaneous increase in the operational reliability.

This object of the invention is achieved by a surge protection device according to the feature combination according to claim 1, wherein the dependent claims at least comprise appropriate embodiments and further developments.

The invention is therefore based on a surge protection device, comprising at least one surge arrester. The surge arrester is preferably formed as a varistor. Furthermore, a thermally trippable switching device is present which is connected in series with the surge arrester. The aforementioned means form a structural unit and can be enclosed by a common housing. The structural unit with the housing represents a plug-in part which can be introduced into a respective socket, for respective mounting on or in the installation to be protected. The plug-in part is easily exchangeable in the event of a malfunction and can be replaced by an intact component.

The thermal tripping means of the switching device is arranged in the region of the expected heating of the surge arrester in the case of its overloading. There is a free choice concerning the arrangement of said tripping means, because the tripping means need not be introduced into the current path of the surge protection device.

Specifically, the thermal tripping means is formed as a stop part through which the operating or surge current does not flow and which releases unlatching of the switching device under thermal overload or unlatches the switching device itself. Furthermore, the stop part is thermally and mechanically coupled to a surface side of the surge arrester and blocks the movement path of a special unlatching slide. The unlatching slide can be produced as a plastic injection-moulded or pressed or cast part, and can therefore be produced at low cost.

Furthermore, the unlatching slide is mechanically prestressed, which can be realised by means of a spring or a similar energy-storage device.

In accordance with the invention, a contact platelet is inserted into the unlatching slide, which comprises an elongated surface section and which produces the desired electrical connection between the elements of the switching device.

With unlatching, the contact platelet is subjected to a displacing movement resulting in an interruption of the series circuit and movement of the unlatching slide into the space previously assumed by the contact platelet, wherein at least the section of the region of the unlatching slide which is moved into said space is formed in an insulated manner or consists of a material that emits a quenching gas.

The dimensions of the contact platelet with respect to the opening or recess of the unlatching slide are selected in such a way that secure contact is ensured with respect to the respective elements of the switching device. The dimensions of the contact platelet concerning the cross-section and thickness for example are based on the desired current carrying capability.

There is the possibility in one embodiment of the invention to provide the contact platelet with fuse properties.

In a further development of the invention, one element of the switching device is formed as a pin or bolt which is under mechanical prestress in the direction of the further element of the switching device. Said further element is a counter-contact, which is electrically connected to the connection side of the surge arrester, e.g. a varistor.

The pin or bolt is connected to a connection bracket. Said connection bracket can simultaneously represent the outer plug connection of the surge arrester formed as a plug-in part.

Furthermore, a rocker, which is also formed as a plastic injection-moulded part and has elastic properties, is provided in accordance with the invention, said rocker being mounted with a first rocker end on a fixed point. Said fixed point can be realised by elements of the housing of the plug-in part. A second rocker end engages on a movable stop.

The rocker which has elastic properties can further consist of a metallic material with respective elastic properties. It can also be considered to provide an embodiment of the rocker as a composite element consisting of plastic and metal. It is relevant that the rocker is capable for the application in accordance with the invention to act as an energy-storage unit without causing any parts of the rocker to break off or break away.

The movable stop is part of a swivel arm, wherein the swivel arm comprises a formed portion which rests on the stop part. Said formed portion can be a tab for example which is an integral component of the swivel arm. The swivel arm can also be realised as a plastic injection-moulded part.

The unlatching slide comprises a blocking arm in accordance with the invention, which is blocked by the swivel arm in the non-tripped state.

Furthermore, the swivel arm comprises a guide recess for an axle pin, wherein the pivoting movement of the swivel arm can be performed about the axis of the axle pin. The axle pin can be an integral component of the housing and extend perpendicularly from the central surface of the housing for example in order to accommodate the swivel arm with the guide recess there.

The swivel arm further comprises a pin protrusion, which penetrates a recess in the base of the housing and can interact with a fault communications device.

The unlatching slide itself is movably mounted in a guide part, wherein the guide part comprises a space for accommodating a spring for the purpose of prestressing the unlatching slide by the spring.

The guide part is configured and dimensioned for the desired electrical properties and consists in this respect of respectively suitable insulation materials, which can deviate from the material of the other parts, especially the housing. As a result, it is thus merely necessary to produce parts of materials which are more expensive and which are subject to a respective electrical load. Both the guide part and also the unlatching slide can consist of an insulating, gas-emitting material such as POM.

In addition, the unlatching slide comprises a state indicator surface. It faces the upper side of the housing of the plug-in part for example and exposes a display surface in green or red for example for the state of "in order" or "defective".

As already mentioned above, the surge arrester is appropriately a varistor, which has a surface side having metallic, conductive properties. A smaller surface portion, which forms the counter-contact and can be a flat metal element for example, extends preferably perpendicularly from the respective surface plane.

In a preferred further development of the invention, the aforementioned surface side comprises fixing surfaces which also extend perpendicularly by way of example from the surface plane and engage in complementary recesses of a respective housing part in order to fix the varistor.

On the rear side, which is opposite of the aforementioned surface side, a further contact of the varistor is present, which is in connection with a further connection bracket which also converges into an electrical exterior connection of the plug-in part of the respective surge protection device.

Figure 2:
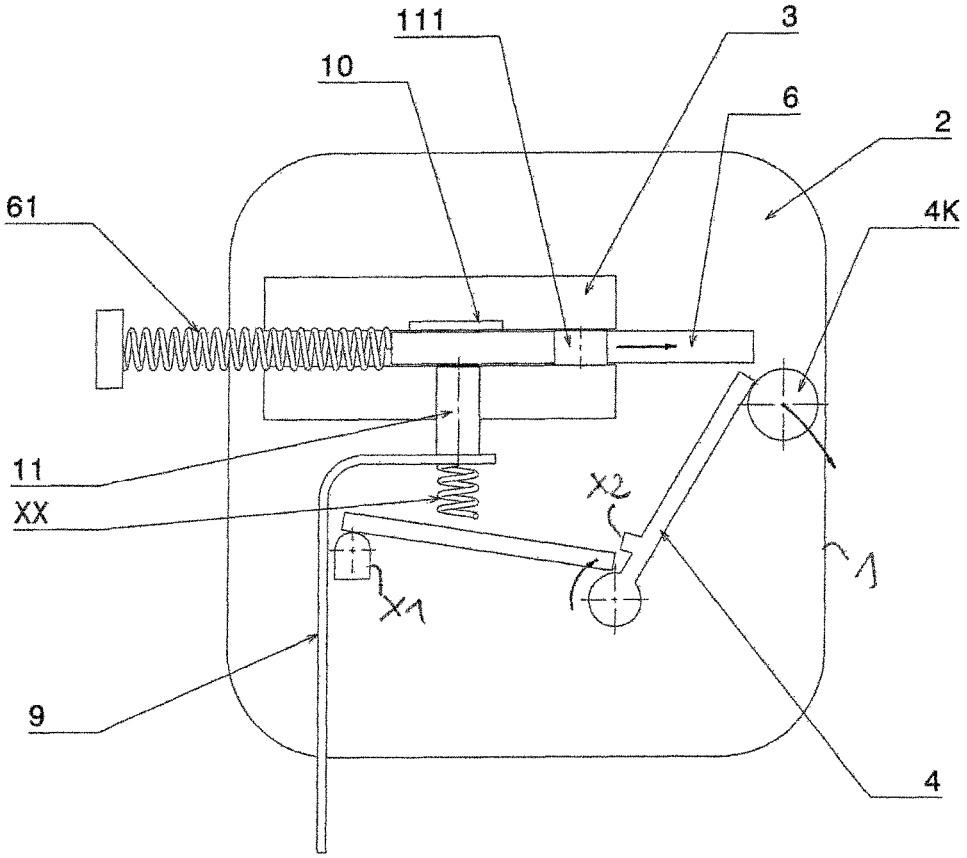
Figure 3:
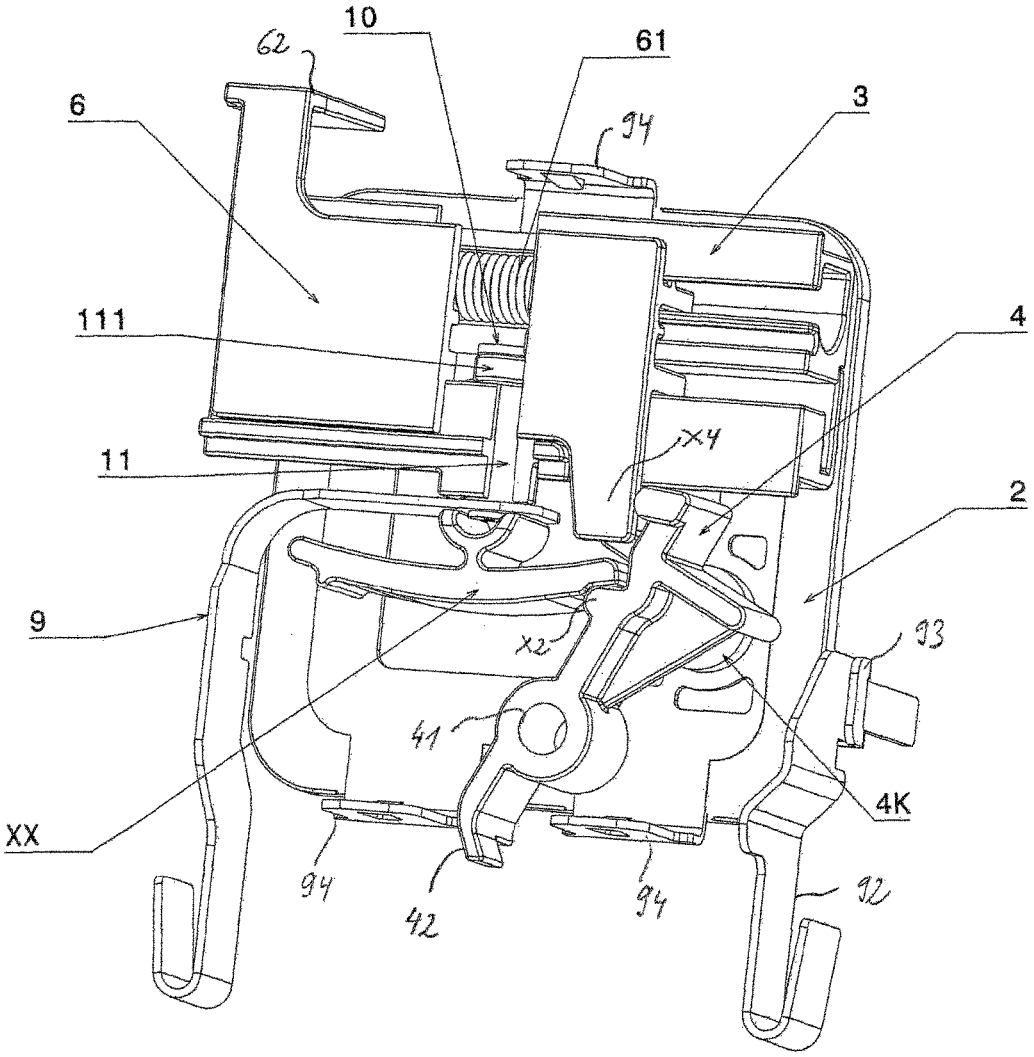
Figure 4:
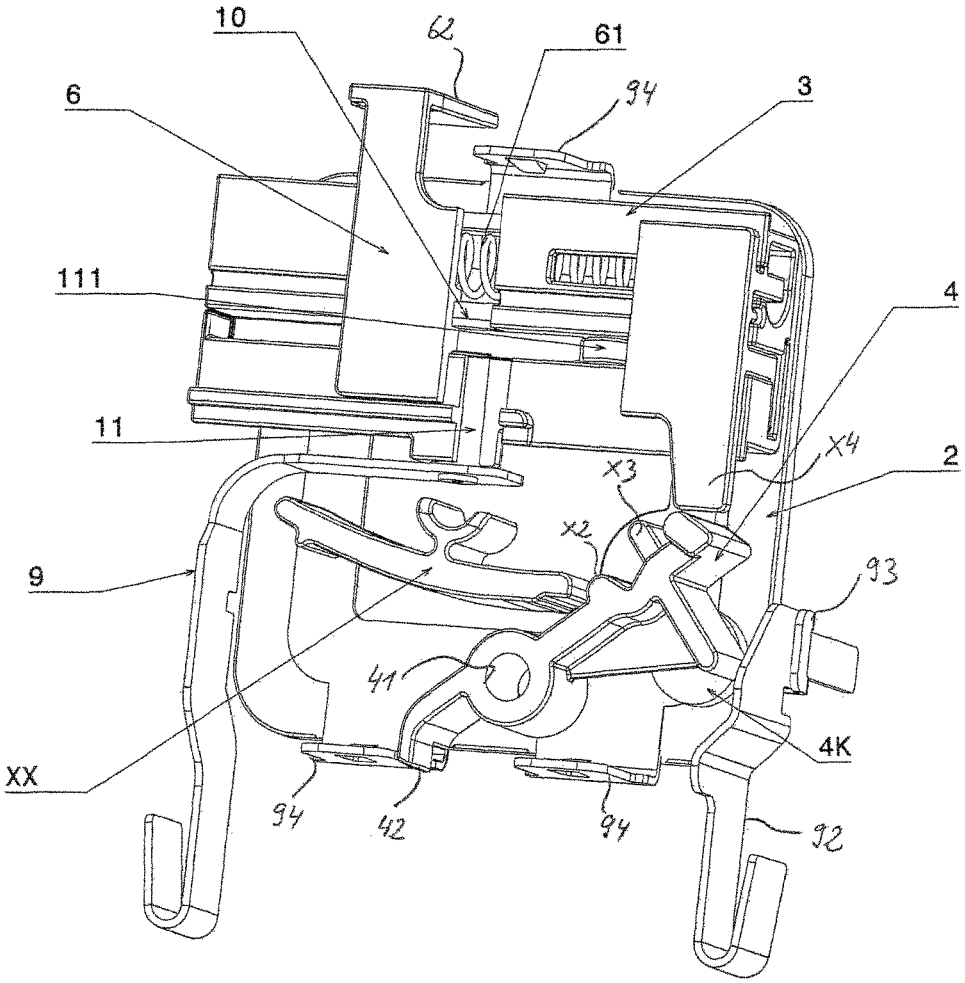

The invention will be explained below in closer detail by reference to an embodiment shown in the drawings, wherein:

FIG. 1 shows a highly simplified, principal configuration of the solution in accordance with the invention in the normal functional state (FIG. 1) and in the cut-off state (FIG. 2), and FIGS. 3 and 4 show a perspective view of the relevant functional elements of the surge protection device in accordance with the invention in the operating state (FIG. 3) and in the cut-off state (FIG. 4), wherein the illustrations according to FIGS. 3 and 4 omit the housing and parts of the housing which finally form the plug-in part for reasons of clarity of the illustration.

As is shown in FIGS. 1 and 2, the surge protection device in accordance with the invention consists first of all of a surge arrester 1, especially a varistor 1, having a respective surface side 2.

A stop part 4K is fixed to the surface side 2 of the varistor 1. Said stop part 4K is fixed by means of a solder for example to the respective surface side 2. When the varistor 1 has a specific temperature which exceeds the permissible operating temperature, the solder melts which connects the stop part 4K to the surface side 2. The stop part 4K then performs a movement in the direction of the arrow.

An unlatching slide 6 is displaceably mounted within a guide part 3, wherein the unlatching slide 6 is under the prestress of a spring 61. The prestress of the spring ensures that the unlatching slide 6 moves to the right relating to FIGS. 1 to 4 when there is no limit stop. This is symbolised with respective displays of arrows within the part 6 in FIGS. 1 and 2.

Furthermore, FIGS. 1 and 2 show the actual switching device, comprising the parts 9, 10 and 11.

A first element is formed as a pin or bolt 11, which is under mechanical prestress, symbolised by the spring XX, in the direction of the further element 10. Said further element 10 forms a counter-contact which is electrically connected to the connection side 2 or the respective surface side and a conductive part of the surge arrester 1 which is present there.

The part 9 can simultaneously form the connecting bracket or a plug-in contact with a bottom end shown in the drawings.

In the normal operating state according to claim 1, the current path is closed via the parts 9, 11, 111 and 10. The part 111 is preferably a contact platelet, which is embedded in a respective recess of the unlatching slide 6. Said contact platelet 111 thus produces the desired connection between the connection bracket 9 and the counter-contact 10, which is in connection with the varistor.

If the permissible operating temperature was exceeded, the stop part or tripping means 4K is released and then reaches a position similar to the one shown in FIG. 2. The unlatching slide 6 can thus move to the right in the direction of the image. The consequence is that the contact platelet 111 is also pushed out of the current path to the right. An insulating section of the unlatching slide now enters the freed-up intermediate space instead of the contact platelet and ensures a very high self-quenching capacity. The respective section of the unlatching slide 6 can consist of a gas-emitting material such as POM, which improves the quenching properties and prevents the production of arcs.

Since the thermal tripping means 4K has left its original position according to FIG. 2, the swivel arm 4 can move to the right according to the shown illustration of the arrow. In this process, the prestressing force also loses its effect by means of the symbolically shown spring XX.

In the case of a realised form of the invention as shown in FIGS. 3 and 4, a rocker XX is present which has elastic properties. The rocker produces a respective prestress, which is still symbolised in FIGS. 1 and 2 by the illustrated spring. A first rocker end is mounted on a fixed point X1. A second rocker end acts on the movable stop X2 of the swivel arm 4.

The movable stop X2 is therefore a part of the swivel arm 4, wherein the swivel arm 4 further comprises a formed portion X3 (see FIGS. 3 and 4) which rests on the stop part or tripping means 4K.

The unlatching slide 6 further comprises a locking arm X4, which in the non-tripped state is blocked by the swivel arm 4 and the end that is still present there, which is especially shown in FIG. 3.

The swivel arm 4 comprises a guide recess 41 for an axle pin (not shown in the drawings), wherein the pivoting movement of the swivel arm 4 can be carried out about the axle pin.

The swivel arm 4 further comprises a pin protrusion 42, which penetrates a recess in the base of the housing (not shown) and can interact with a fault communications device (also not shown).

It is shown in FIGS. 3 and 4 that the unlatching slide 6 is movably mounted in the guide part 3, wherein the guide part 3 comprises a space for accommodating the spring 61.

FIGS. 3 and 4 also show the state indicator surface 62, which is formed on or integrally attached to the unlatching slide 6.

A further connection bracket 92, whose bottom end forms one of the plug-in contacts of the plug-in part and which accommodates the surge protection device, is in connection with a further contact 93 of the surge arrester 1.

The surge arrester 1 comprises several fixing surfaces 94, which are formed as metallic bent sections for example which engage in complementary recesses of a housing part (not shown) and hold the varistor there.

The invention claimed is:

1. A surge protection device, comprising at least one surge arrester (1) and one thermally trippable switching device (9; 10; 11) connected in series with the surge arrester (1), wherein the at least one surge arrester and one thermally trippable switching device form a structural unit and a thermal tripping means (4K) is arranged in the region in which heating of the surge arrester (1) is to be expected on overloading thereof, wherein the thermal tripping means (4K) is formed as a stop part through which no operating or surge current flows and which releases unlatching of the switching device in the case of thermal overload, wherein the stop part (4K) is further coupled thermally and mechanically to a surface side (2) of the surge arrester (1) and blocks the movement path of a mechanically prestressed unlatching slide (6), wherein the thermally trippable switching device comprises at least a first element 9, a second element 10 and a third element 11, wherein a contact platelet (111) is inserted into the unlatching slide (6), said contact platelet producing an electrical connection between the second element (10) and the third element (11) of the switching device, wherein the contact platelet (111), with unlatching, is subjected to a shifting movement resulting in an interruption to the series circuit of the switching device and movement of the unlatching slide (6) into the space previously assumed by the contact platelet (111), wherein at least the section of the region of the unlatching slide which separates the second element (10) and the third element (11) of the switching device is formed in an insulating manner, characterized in that the third element (11) of the switching device is formed as a pin or bolt, which is mechanically prestressed in the direction of the second element (10), wherein the first element (9) is a connection bracket, wherein the second element (10) is a counter-contact which is electrically connected to the connection surface of the surge arrester (1), wherein the pin or bolt is connected to the connection bracket, and a rocker (XX) having elastic properties is provided, which is mounted with a first rocker end on a fixed point (X1) and acts with a second rocker end on a movable stop (X2).

2. A surge protection device according to claim 1, characterized in that the movable stop (X2) is part of a swivel arm (4), wherein the swivel arm (4) comprises a formed portion (X3) which rests on the stop part (4K).

3. A surge protection device according to claim 2, characterized in that the unlatching slide (6) comprises a blocking arm (X4), which in the non-tripped state is blocked by the swivel arm (4).

4. A surge protection device according to claim 3, characterized in that the swivel arm (4) comprises a guide recess (41) for an axle pin, wherein the pivoting movement can be carried out about the axle pin.

5. A surge protection device according to claim 2, characterized in that the swivel arm (4) comprises a pin protrusion (42) which penetrates a recess in the base of the housing and interacts with a fault communications device.

6. A surge protection device according to claim 1, characterized in that the unlatching slide (6) is movably mounted in a guide part (3), wherein the guide part (3) comprises a space for accommodating a spring (61).

7. A surge protection device according to claim 3, characterized in that the unlatching slide (6) comprises a state indicator surface (62).

8. A surge protection device according to claim 1, characterized in that the surge arrester is a varistor which comprises a surface side (2) having metallic, conductive properties and from which a surface portion extends which forms the counter-contact (10).

9. A surge protection device according to claim 1, characterized in that a further connection bracket (92) is connected to a contact (93) of the surge arrester (1).

10. A surge protection device according to claim 1, characterized in that fixing surfaces (94) are disposed on the surge arrester (1) which engage in complementary recesses of a housing part.

* * * * *